US011571349B2

(12) United States Patent
Johnson et al.

(10) Patent No.: US 11,571,349 B2
(45) Date of Patent: Feb. 7, 2023

(54) ADAPTIVE ERGONOMIC POSITIONING DEVICE

(71) Applicants: David A. Johnson, Bigfork, MT (US); Lance L. Ercanbrack, Libby, MT (US); Kent B. Gustin, Libby, MT (US)

(72) Inventors: David A. Johnson, Bigfork, MT (US); Lance L. Ercanbrack, Libby, MT (US); Kent B. Gustin, Libby, MT (US)

( * ) Notice: Subject to any disclaimer, the term of this patent is extended or adjusted under 35 U.S.C. 154(b) by 385 days.

(21) Appl. No.: 16/499,953

(22) PCT Filed: Mar. 20, 2019

(86) PCT No.: PCT/US2019/023273
§ 371 (c)(1),
(2) Date: Oct. 1, 2019

(87) PCT Pub. No.: WO2019/183293
PCT Pub. Date: Sep. 26, 2019

(65) Prior Publication Data

US 2021/0212876 A1 Jul. 15, 2021

Related U.S. Application Data

(60) Provisional application No. 62/646,445, filed on Mar. 22, 2018.

(51) Int. Cl.
*A61G 13/12* (2006.01)
*A61G 15/12* (2006.01)

(52) U.S. Cl.
CPC ..... *A61G 13/121* (2013.01); *A61G 13/1235* (2013.01); *A61G 15/125* (2013.01)

(58) Field of Classification Search
CPC ..... A61G 13/1285; A61G 13/009; A61G 13/121; A61G 13/1235; A61G 13/125; A61G 2200/327
See application file for complete search history.

(56) References Cited

U.S. PATENT DOCUMENTS 2,459,033 A 1/1949 Kraus
2,507,172 A 5/1950 Naclerio
(Continued)

FOREIGN PATENT DOCUMENTS

WO WO2010/040120 A2 4/2010

OTHER PUBLICATIONS http://huaxier.en.alibaba.com/product/635652422214308297/Head_Rest_with_Wist_Support_Medical_Equipments_Accessories.html.
(Continued)

*Primary Examiner* — David R Hare
*Assistant Examiner* — Adam C Ortiz
(74) *Attorney, Agent, or Firm* — Mitchell J. W. Vap

(57) ABSTRACT

The herein described Adaptive Ergonomic Positioning device ("AEPD") relates generally to the field of surgery and other medical or healthcare procedures. The AEPD can be adapted for use with most standard surgical tables and surgical chairs where the patient must be positioned prone during a particular procedure. The AEPD may also be used for certain procedures where the patient may be positioned supine. The AEPD support assemblies are highly adjustable and deliver improved ergonomics for both patients and providers. Patients of different morphology can be comfortably positioned in prone with their head and neck in a neutral position, and shoulders in a forward flexed, slightly internally rotated position. The AEPD can be adjusted to accommodate patients with neck and shoulder mobility restrictions, without any effect on provider accessibility to the surgical or treatment site.

17 Claims, 9 Drawing Sheets

(56) References Cited

U.S. PATENT DOCUMENTS

| | | | | |
|---|---|---|---|---|
| 2,642,250 | A | 6/1953 | Kasnowich | |
| 2,972,505 | A | 2/1961 | Weickgenannt | |
| 3,828,377 | A | 8/1974 | Fary, Sr. | |
| 4,333,638 | A | 6/1982 | Gillotti | |
| 4,404,966 | A | 9/1983 | Hartman | |
| 4,620,697 | A * | 11/1986 | Pithon | A61G 13/121 5/640 |
| 4,698,837 | A | 10/1987 | Van Steenburg | |
| 4,720,881 | A | 1/1988 | Meyers | |
| 4,757,983 | A | 7/1988 | Ray et al. | |
| 4,881,728 | A | 11/1989 | Hunter | |
| 4,988,062 | A | 1/1991 | London | |
| 5,287,575 | A | 2/1994 | Allen et al. | |
| 5,347,668 | A | 9/1994 | Manning | |
| 6,049,926 | A | 4/2000 | Amaral | |
| 6,276,012 | B2 | 8/2001 | Borders | |
| 6,336,412 | B2 | 1/2002 | Heimbrock et al. | |
| 6,701,554 | B2 | 3/2004 | Heimbrock | |
| 6,718,581 | B2 | 4/2004 | Riach | |
| 6,898,810 | B2 | 5/2005 | Steven | |
| 7,676,867 | B2 | 3/2010 | De Laura | |
| D659,250 | S | 5/2012 | Cottrell | |
| 8,234,731 | B2 | 8/2012 | Skripps | |
| 8,235,877 | B2 | 8/2012 | Boren | |
| 8,272,089 | B1 * | 9/2012 | Stokes | A61G 13/1235 5/735 |
| 8,700,131 | B2 | 4/2014 | Goff et al. | |
| 9,009,894 | B2 | 4/2015 | Radermacher | |
| 9,278,041 | B2 * | 3/2016 | Riach | A61G 13/1285 |
| 2006/0290194 | A1 * | 12/2006 | Roleder | A47C 20/026 297/397 |
| 2013/0086747 | A1 * | 4/2013 | Gharieni | A61G 13/121 5/622 |
| 2018/0085270 | A1 * | 3/2018 | Elias | A61G 7/075 |
| 2020/0146639 | A1 * | 5/2020 | Campagna | A61G 13/1225 |

OTHER PUBLICATIONS http://www.athlegen.com.au/shop/genesispronearmrest.
http://www.fellston.com/product.asp?ID=2145&name=Hanging+Massage+Table+Arm+Rest+%28Shelf+Style%29.
http://www.salonequipmentsource.com/spaequipment/ spatables/ spatableaccessories/ armshelf/ tableextender/.
http://www.mizuhosi.com/products/trios/.

* cited by examiner

ADAPTIVE ERGONOMIC POSITIONING DEVICE

CROSS-REFERENCE TO RELATED APPLICATIONS

This application claims the benefit of U.S. Provisional Application No. 62/646,445 filed on Mar. 22, 2018, the disclosure of which is hereby incorporated by reference in its entirety to provide continuity of disclosure.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

The herein described Adaptive Ergonomic Positioning Device ("AEPD") relates generally to the field of surgery and other medical or healthcare procedures. The AEPD can be utilized with standard surgical tables or chairs where the patient must be positioned prone during a particular procedure. The AEPD may also be utilized for certain surgical procedures requiring supine positioning.

Many surgical and other healthcare related procedures necessitate a patient to be positioned prone so the surgeon or healthcare practitioner can access the surgical or treatment site. Standard high-low surgical tables generally have removable sections at the head and foot ends of the table, which lack adjustability. Some models of standard surgical tables provide "arm board attachments" which simply attach to the sides of the standard table to increase the width of the table for patient arm positioning during surgery. Such arm board attachments provide minimal adjustability and generally do not allow for the patient's arms to be supported in a comfortable neutral anatomical position. Furthermore, standard arm board attachments increase the distance across which the surgeon or other healthcare practitioner must reach to access dorsal surgical or treatment sites on the patient. Many surgical chairs recline to similarly accommodate prone patient positioning and present similar issues with attached arm boards and less than optimal practitioner access.

Typical patient prone positioning used today by surgeons and medical providers generally consists of the patient lying prone on the surgical table, with their head on a pillow, rotated 90 degrees to one side. The patient's arms are then abducted to approximately 90 degrees and externally rotated at the shoulder approximately 90 degrees. This position is sometimes referred to as the "superman" position. Surgical chairs typically support the patient's head on a cushion extension with similar arm positioning.

Many people lack 90 degrees of neck rotation. For most people, maintaining their neck in a 90-degree rotated position for any appreciable length of time causes significant discomfort. Similarly, many people lack 90 degrees of shoulder external rotation, or have pre-existing injuries or instability that causes discomfort when the shoulder is abducted and externally rotated. While a conscious patient may be able to verbalize discomfort and request re-positioning, unconscious or sedated patients cannot. As such, prolonged prone positioning that strains tissues can lead to patient discomfort, injury, and negative procedural outcomes.

A common complication from prone patient positioning during surgery is brachial plexus nerve damage resulting from prolonged traction to the brachial plexus. The brachial plexus is fixed at the cervical vertebra and the axillary fascia. *Brachial plexus injury following spinal surgery*, Uribe J S, Kolla J, Omar H, Dakwar E, Abel N, Mangar D, Camporesi E; J Neurosurg Spine (2010 October; 13(4):552-8). As such, patients in the standard prone surgical position are susceptible to traction and extension type injuries to the brachial plexus. Surgical positioning induced brachial plexus injuries can range from minor and temporary, to major and permanent. Patients who must be in the standard prone surgical position for significant amounts of time are also more susceptible to other neural, dermal, facial, muscular or skeletal injuries as well.

Standard prone positioning during surgical and other procedures also presents ergonomic issues for surgeons and other practitioners. The abducted and externally rotated position of the patient's arms requires the surgeon and surgical personnel to perform more reaching and bending to work on certain surgical or procedural areas. Unnecessary bending and over-reaching leads to fatigue, potential injury of providers and assisting personnel, and the possibility of inaccuracy during delicate procedures.

Patient complications and practitioner fatigue/injury are significant factors that negatively affect patient outcomes and increase the cost of providing healthcare. Prone positioning on standard surgical tables or chairs has been shown to contribute to negative patient outcomes and provider fatigue/injury. *Complications associated with prone positioning in elective spinal surgery*. J Mason DePasse, Mark A Palumbo, Maahir Haque, Craig P Eberson, and Alan H Daniels; World J Orthop (2015 Apr. 18; 6(3): 351-359).

Attempts have been made to improve prone patient positioning during surgery or other procedures. Such attempts have generally included the development of highly specialized surgical tables for spine surgery. While, such tables have some improved characteristics over standard surgical tables for prone surgery, they are (1) extremely expensive, (2) highly specialized for spinal surgery, and (3) still lack head/neck and upper extremity adjustability. Such a specialized table is not practical, nor economical for smaller, especially rural, facilities that must accommodate a limited amount of prone surgical and/or other medical procedures.

Due to the complications and cost issues noted above with prone patient positioning during surgery and other procedures, there remains a need for the Adaptive Ergonomic Positioning Device ("AEPD") disclosed herein. The AEPD is designed to be interchangeable with the head end segment of standard brand/model surgical tables and chairs. As such, facilities with existing standard surgical tables or chairs can utilize the AEPD with their existing equipment to improve patient positioning during prone procedures.

The AEPD head and arm assembly is highly adjustable so that patients of different morphology can be comfortably positioned in prone with their head and neck in a neutral position, and shoulders in a forward flexed, slightly internally rotated position. The AEPD can be adjusted to accommodate patients with neck and shoulder mobility restrictions, without any effect on provider accessibility to the surgical or treatment site.

Due to the issues with the prior art discussed above, the objectives of the present invention include: (1) provide a positioning device readily adaptable to use on standard surgical tables and chairs, (2) provide an economical AEPD, which can be simply and reliably utilized for a wide variety of procedures, including but not limited to procedures where the patient is:

a. fully conscious or awake, b. sedated but conscious, or c. under general anesthesia and unconscious;

(3) provide more comfort and relaxed positioning for patients in the prone position during surgical and other medical procedures; (4) reduce or eliminate risks for patients, providers, hospitals and surgical centers associated with prolonged prone positioning during surgical and other medical procedures; (5) improve patient experience and reduce anxiety regarding surgical and other medical procedures; (6) improve provider ergonomics, allowing an easier, shorter "reach" to the patient's body and improved access to the surgical site(s) without having to bend over, or work around, the patient's arms extended on standard arm boards; (7) provide an improved view of the surgical or treatment site(s); (8) provide easy access to, and ability to move, patients' arms and hands for IV management and monitoring processes; and (9) provide for increased patient safety during prone surgical and other medical procedures.

BRIEF SUMMARY OF THE INVENTION

The AEPD disclosed herein solves the problems outlined above. The key feature of the AEPD is that it is designed so that the table/chair insert assembly can be fabricated to be interchangeable with the head end segment of most brands and models of standard surgical tables and chairs. However, it should be noted that the AEPD table/chair insert assembly can also be further customized to connect via virtually any available attachment means of any brand or model of surgical/procedure table or chair. In the preferred embodiment described herein, the majority of the components of the AEPD are made of 5052 and 6061 aluminum, while certain components are made from T-304 polished stainless steel for extra strength. Various bolts and screws are made of stainless steel. Some of the adjustment assemblies of the preferred embodiment employ plastic knobs and UHMW plastic bushings. Even though specific materials are disclosed herein regarding the fabrication and construction of this embodiment, it should be noted that stainless steel, composite materials and other materials could be used exclusively without impairing the function of the AEPD and are contemplated within the scope of this disclosure. It should also be noted that anatomical or engineering computer simulations could be used to validate and/or drive minor modifications to various dimensions of the AEPD and such changes are contemplated within the scope of this disclosure Cushioning pads for the chest support, head support, and arm board assemblies are made of anti-bacterial/anti-fungal rated open cell foam rubber with various thicknesses, densities and compression ratings. The pads have a sewn cover made of anti-bacterial/anti-stain vinyl rated for medical use. The pads are attached to their respective support assemblies with ordinary hook and loop Velcro strips. Even though specific materials are disclosed herein regarding the fabrication and construction of this embodiment, it should be noted that modern surgical gel pads might alternatively be employed and even other materials, e.g. modern gel filling instead of foam rubber, could be utilized in the fabrication and construction of the cushioning pads and are contemplated within the scope of this disclosure.

One of the main features of the AEPD disclosed herein is the complete adjustability of the individual support components to accommodate patients of different morphology and joint restrictions. The main support assembly, which supports the patient's chest, can be adjusted up and down by utilizing different pad thicknesses, widths, and lengths for male/female patients of different chest sizes. The arm board assemblies can be adjusted up and down vertically to accommodate humeral length, and scapular protraction/retraction. The arm board assemblies can be adjusted for width to accommodate patients of varying chest width. The arm board assemblies can also be rotated in the horizontal plane to accommodate differing degrees of shoulder internal/external rotation. The head support assembly can be adjusted longitudinally to accommodate patients with different chin to chest spacing. The head support assembly can also be adjusted vertically to accommodate lower cervical spine flexion/extension and tilted in the sagittal plane to accommodate upper cervical flexion/extension. As such, the patient's optimal prone positioning can be established prior to anesthesia administration to allow the patient to verbalize satisfactory comfort. Furthermore, the patient's position during surgery can be easily adjusted by the simple manipulation of the AEPD's various adjustment features.

REFERENCE LISTING

100—Standard Surgical Table (Prior Art)

101—Head End Table Segment (Prior Art)

Figure 1:
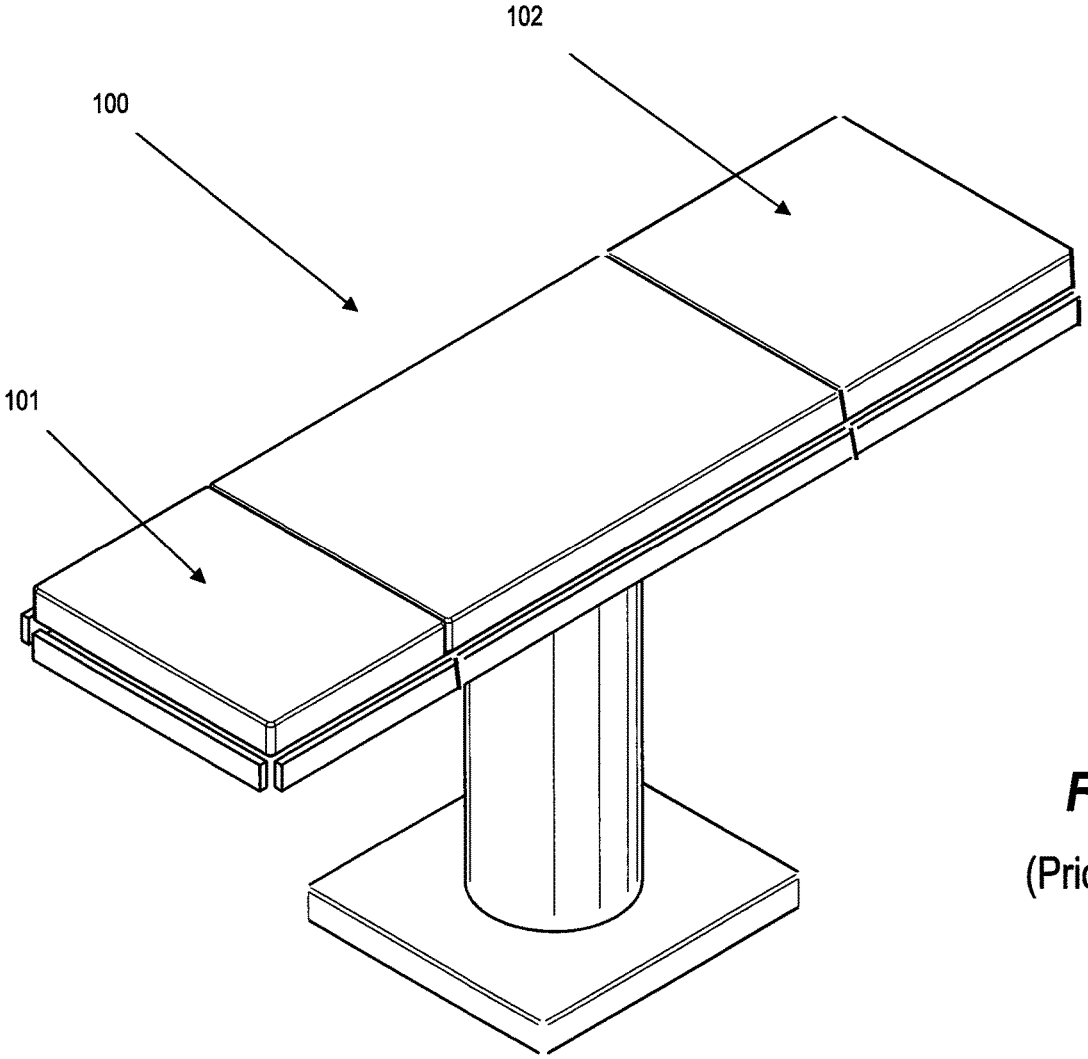
FIG. 1 (Prior Art)
FIG. 1 (Prior Art) is a perspective view of a standard surgical table
Figure 2:
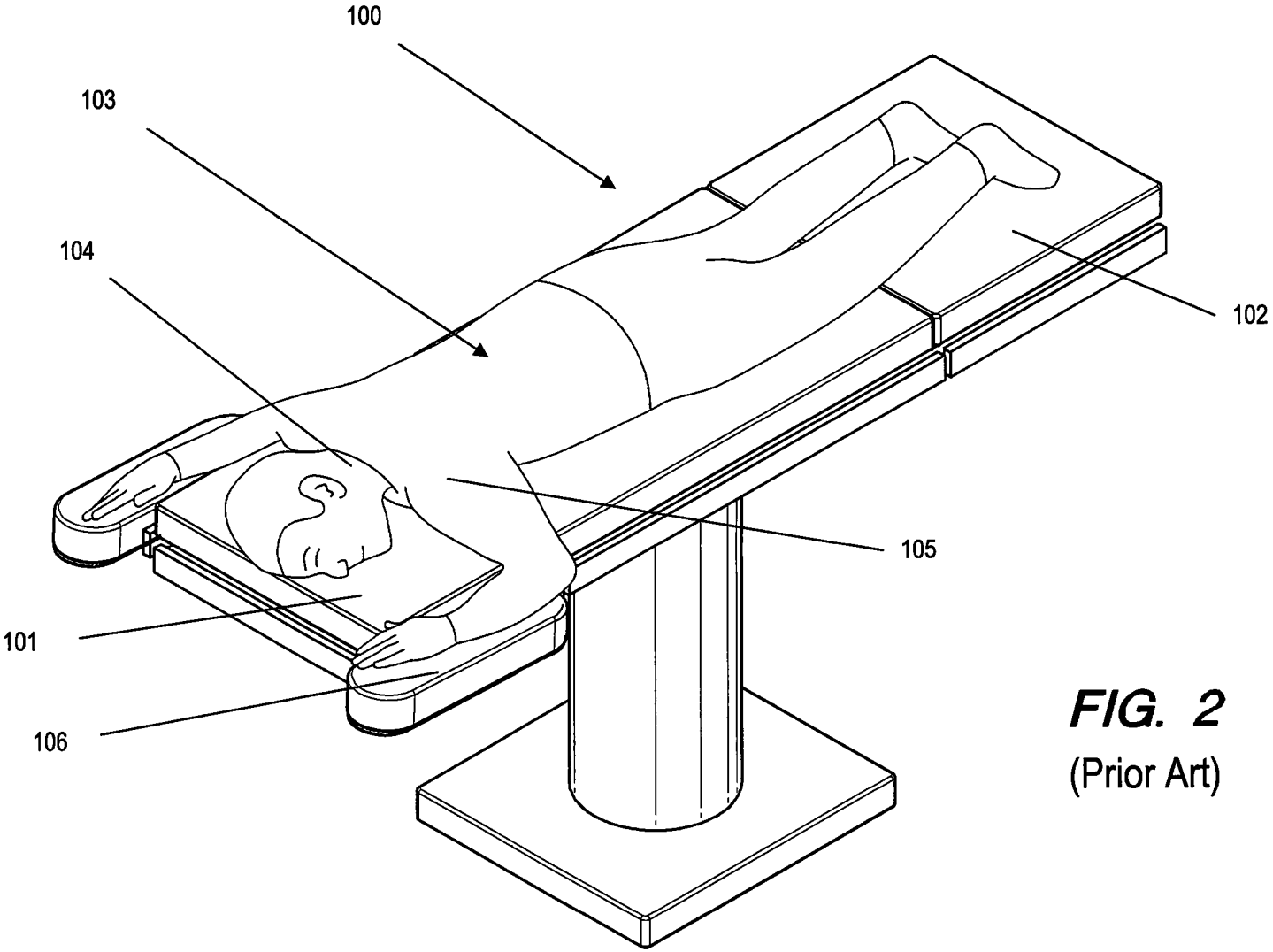
FIG. 2 (Prior Art)
FIG. 2 (Prior Art) is a perspective view of a patient in the prone position on a standard surgical table demonstrating head/neck rotated 90 degrees to one side, and arms abducted to approximately 90 degrees and externally rotated approximately 90 degrees. This position is sometimes referred to as the "superman" position.

102—Foot End Table Segment (Prior Art)
103—Patient
104—Patient neck
105—Patient Shoulder
106—Standard Arm Board Attachment (Prior Art)
107—Existing Head End Table Segment Attachment Means (Prior Art)
110—Standard Surgical Chair (Prior Art)
111—Existing Head End Chair Segment Attachment Means (Prior Art)
200—AEPD
210—Insert Assembly
211*a*—Table Insert Frame
211*b*—Chair Insert Frame
212*a*—Table Insert Rod
212*b*—Chair Insert Plate
220—Main Support Assembly
221—Main Support Frame
221*a*—Main Support Frame Chest Support Plate
221*b*—Chest Cushion
221*c*—Main Support Frame Vertical Section
221*d*—Main Support Frame Head Support Slide Rod Receiver
222—Arm Board Rail
222*a*—Arm Board Rail Through Holes
222*b*—Arm Board Rail Plastic Round Knob With Threaded Stud
223—Arm Board Rail Bracket
223*a*—Arm Board Rail Bracket Plastic Round Knob With Threaded Stud
224—Arm Board Rail Bracket Threaded Holes
229—Head Support Assembly
230—Head Support Slide Bar
231—Head Support Slide Rod
232—Head Support Arm
233—Head Support Slide Rod Stop
234—Head Support Slide Bar Rotating Rosette Lock Bodies
236—Face Plate
237—Face Plate Rotating Rosette Lock Bodies
239—Face Plate Support Arm Bracket
242—Face Plate Support Arm Rotating Rosette Adjustment Knob
250—Face Cushion
260—Arm Support Assembly
261—Arm Board Rotation Bracket
263—Arm Board Bearing Plate
262—Arm Board
264—Arm Board Rotation Bracket Flathead Hex Drive Screw
265—Arm Board Rotation Bracket Central Hole
266—Arm Board Rotation Bracket Outward Facing Teeth
267—Arm Board Twist-to-Lock Knob-Style Retractable Spring Plunger
268—Arm Cushion

DETAILED DESCRIPTION OF THE INVENTION

The AEPD 200 is designed so that an insert assembly 210 can be fabricated to be interchangeable with the head end table segment 101 of most brands and models of standard surgical tables 100 and surgical chairs 110. However, it should be noted that the AEPD 200 insert assembly 210 could also be easily further customized to connect via virtually any existing head end table segment attachment means 107 of any standard surgical table 100 or any standard surgical chair head end chair segment means 111. In the preferred embodiment described herein, the majority of the components of the AEPD 200 are made of 5052 and 6061 aluminum, while certain components are made from T-304 polished stainless steel for extra strength. Fabrication of the AEPD 200 generally involves cutting and welding various components but other means such as casting, stamping and CNC machining might also be used and are contemplated within the scope of this disclosure. Various bolts and screws, which provide the connection means for the AEPD 200 components, are made of stainless steel. While bolts and screws are the preferred connection means for the embodiment described herein, other connection means could be utilized including but not limited to: welding, cotter pins, rivets, etc. The use of such other connection means is contemplated within the scope of this disclosure. Some of the adjustment assemblies of the primary embodiment employ plastic knobs and UHMW plastic bushings. Even though specific materials are disclosed herein regarding the fabrication and construction of this embodiment, it should be noted that stainless steel, composite materials and other materials could be used exclusively without impairing the function of the AEPD and are contemplated within the scope of this disclosure.

The chest cushion 221*b*, face cushion 250, and arm cushions 268 are made of anti-bacterial/anti-fungal rated open cell foam rubber with various thicknesses, densities and compression ratings. The pads have a sewn cover made of anti-bacterial/anti-stain vinyl rated for medical use. The pads are attached to their respective support assemblies with ordinary hook and loop Velcro strips. Even though specific materials are disclosed herein regarding the fabrication and construction of this embodiment, it should be noted that modern surgical gel pads might alternatively be employed and even other materials such as modern gel fillings could be utilized in the fabrication and construction of the cushioning pads and are contemplated within the scope of this disclosure.

The AEPD disclosed herein is comprised of: an insert assembly 210; main support assembly 220; head support assembly 229; and two arm support assemblies 260. The insert assembly 210 provides the customizable connection means to the standard surgical table 100 with the head end table segment 101 removed and the standard surgical chair 110. An embodiment of the insert assembly 210 described herein is comprised of a table insert frame 211*a* and two table insert rods 212*a*, which slide into the existing head end table segment attachment means 107, to establish a firm connection between the AEPD 200 and the standard surgical table 100. The diameter and length of the table insert rods 212*a* and the horizontal and vertical spacing of the rods on the table insert frame 211*a* are custom fabricated to fit specific brands and models of common surgical tables 100. Customization can also accommodate tables using radiographic risers and match those higher table surface levels.

In another embodiment, an insert assembly 210 is available for standard surgical chair head end chair segment means 111. The insert assembly 210 is comprised of a chair insert frame 211*b* and a chair insert plate 212*b*, which slides into the existing head end chair segment attachment means 111, to establish a firm connection between the AEPD 200 and a standard surgical chair 110.

Figure 3:
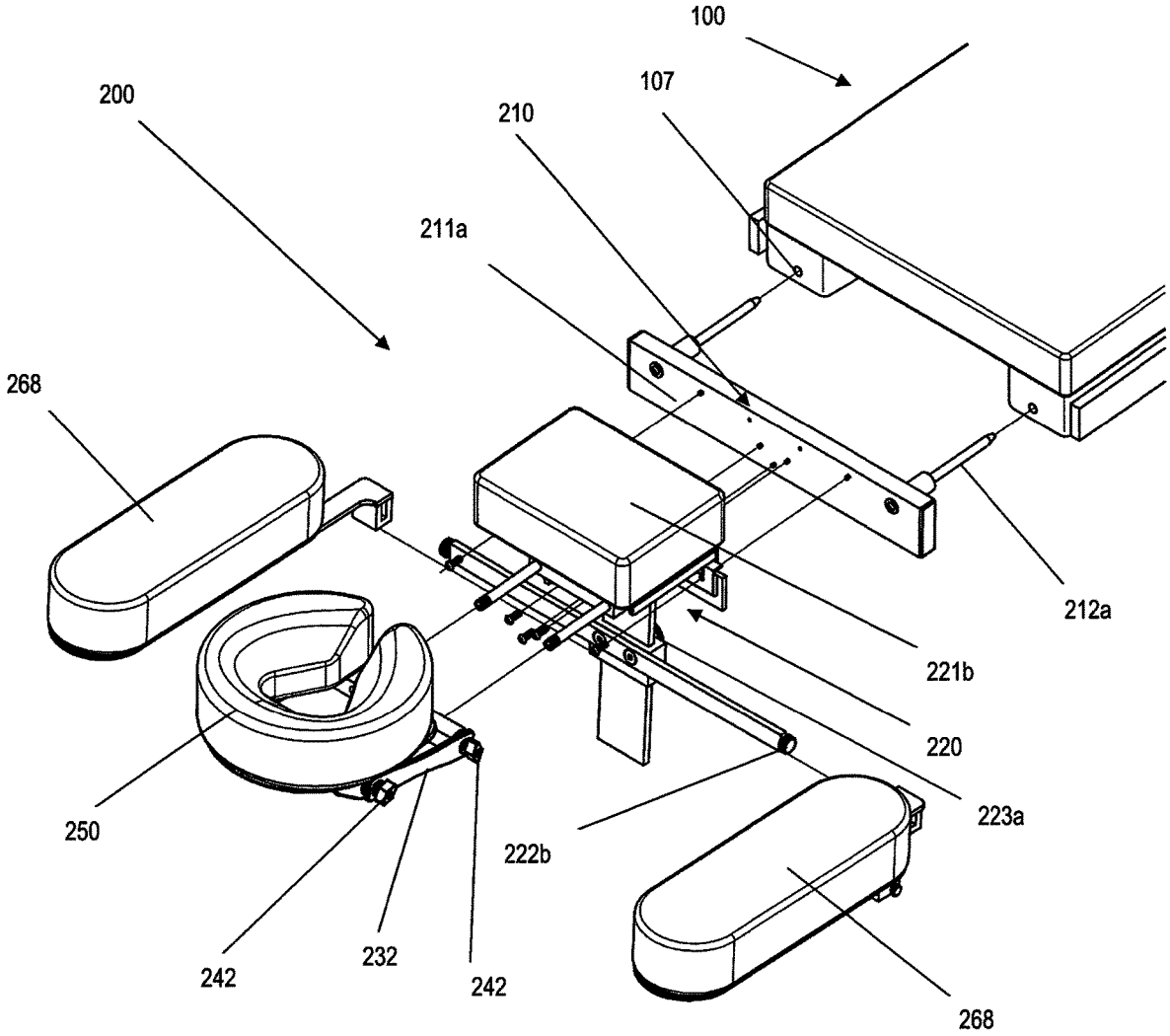
FIG. 3 is a perspective view of a preferred embodiment of the AEPD, partially disassembled, showing how the main support assembly inserts into existing mounting means of the head end segment of a standard surgical table.

The main support assembly 220 is connected to the table insert assembly 210 by a plurality of screws and washers as shown on FIG. 3. The main support assembly 220 is primarily comprised of a main support frame 221. The upper, horizontal portion of the main support frame 221 comprises a chest support plate 221*a*. The vertical portion 221*c* of the main support frame 221 accepts an arm board rail bracket 223 which is slid onto the bottom of the vertical portion 221*c* of the main support frame 221. The arm board rail bracket 223 provides the connection means for the arm board rail 222, by which the arm support assemblies 260 are attached to the main support frame 221. The arm board rail bracket 223 can be slid up and down to adjust the height of the arm support assemblies 260. The arm board rail bracket 223 is secured against the back side of the vertical portion 221*c* of the main support frame 221 by inserting and tightening an arm board rail bracket plastic round knob with threaded stud 223*a* into the corresponding threaded hole on the back side of the arm board rail bracket 223 against the vertical portion 221*c* of the main support frame 221. The arm board rail bracket 223 and arm board rail 222 are connected with standard round head hex drive screws and washers by installing said screws into corresponding holes 222*a* in the arm board rail 222 and threaded holes 224 in the arm board bracket 223. Each end of the arm board rail 222 includes a threaded hole, in which an arm board rail plastic round knob with threaded stud 222*b* is installed to provide a stop that prevents the arm board rotation bracket 261 from falling off the rail. The main support frame 221 is also comprised of a head support slide rod receiver 221*d*, which accepts the head support slide rods 231 of the head support assembly 229. A chest support plate 221*a* is welded to the upper portion of the main support frame 221 and provides a surface for the chest cushion 221*b* to be attached.

Head support slide rods 231 insert through the corresponding holes of the main support frame head support slide rod receiver 221*d* and provide the means to connect the head support assembly 229 to the main support frame 221. The head support slide rods 231 slide through the corresponding holes of the main support frame head support slide rod receiver 221*d* which provides the means to adjust the head support assembly 229 longitudinally. The rear, or foot, end of the head support slide rods 231 includes a threaded hole with a round head hex drive screw and washer which comprise the head support slide rod stops 233. The front, or head, end of the head support slide rod 231 are firmly attached to the head support slide bar 230 with flat head slotted head screws. The head support assembly 229 is further comprised of two head support arms 232. Said head support arms 232 are comprised of a rear, or foot, end, which connects to the corresponding end of the head support slide bar 230. The front, or head, ends of the head support arms 232 are connected to the corresponding face plate support arm bracket 239 of the face plate 236. The head support arms 232 are connected at their respective ends by rotating rosette lock bodies 234, 237 with threaded studs, springs and plastic adjustment knobs 242 which allow for rotational and vertical adjustment of the face plate 236. The upper surface of the face plate 236 provides a means for removably connecting a face cushion 250. The embodiment described herein utilizes a standard hook and loop Velcro system for removably connecting the face cushion 250 to the face plate 236; however, one skilled in the art would realize that alternate means could be utilized to accomplish this function.

The AEPD arm support assemblies 260 are installed on the arm board rail 222 by sliding the corresponding left or right arm board rotation brackets 261 onto the arm board rail 222. The arm board rotation brackets are further comprised of corresponding arm board bearing plates 263 with nylon washers, which provide the locking and rotation means for adjusting the rotational angle of the arm boards 262 in the horizontal plane. Corresponding arm boards 262 are further comprised of a flat head hex drive screw 264, which inserts through the arm board bearing plate 263 central hole 265, which provides for the attachment and rotation point of the arm boards 262. The corresponding arm boards 262 are secured to the arm board bearing plates 263 by a standard locknut tightened on said flat head hex drive screw 264.

Each corresponding arm board bearing plate 263 is further comprised of a plurality of outward facing teeth 266, which articulate with a corresponding arm board twist-to-lock retractable spring plunger 267 mechanism to lock the arm boards 262 at the appropriate angle in the horizontal plane. An arm cushion 268 is removably connected to the upper surface of each arm board 262. The embodiment described herein utilizes a standard hook and loop Velcro system for removably connecting the arm cushions 268 to the arm boards 262; however, one skilled in the art would realize that alternate means could be utilized to accomplish this function.

Figure 4:
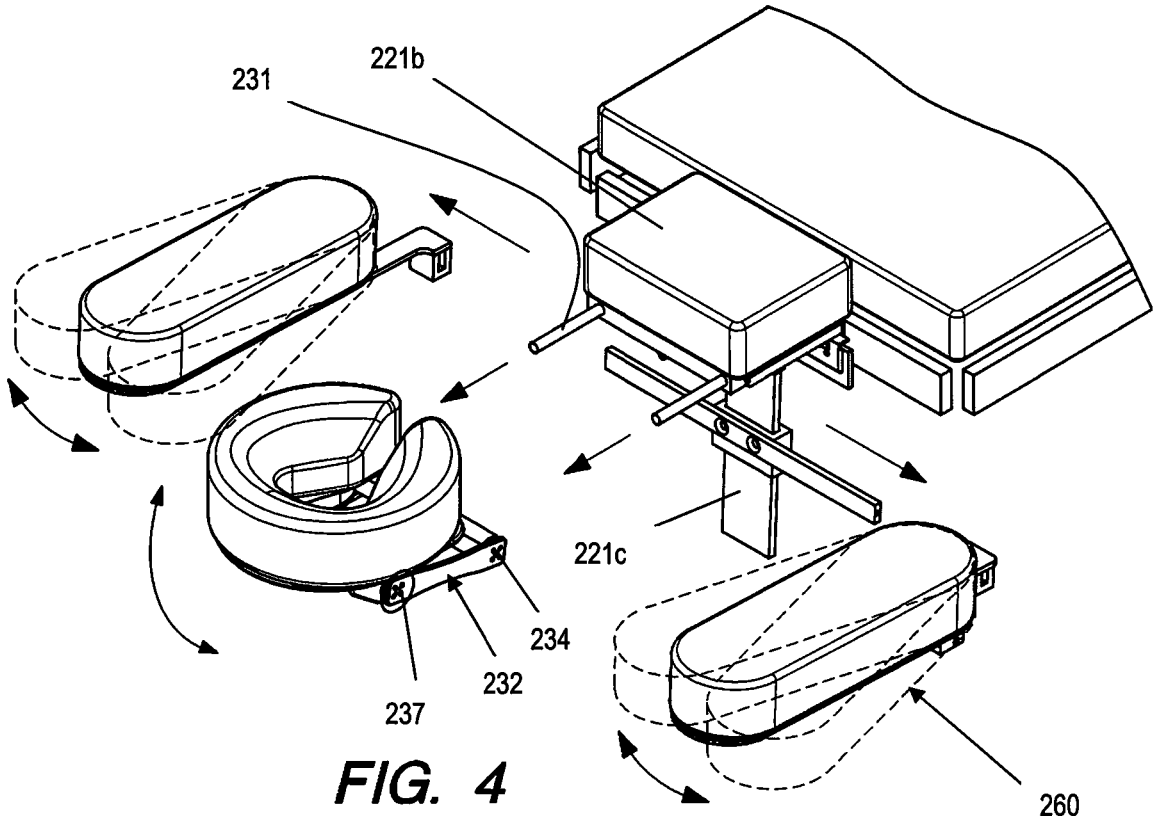
FIG. 4 is a perspective view of a preferred embodiment of the AEPD, partially disassembled demonstrating adjustability of various support assembly components.
Figure 5:
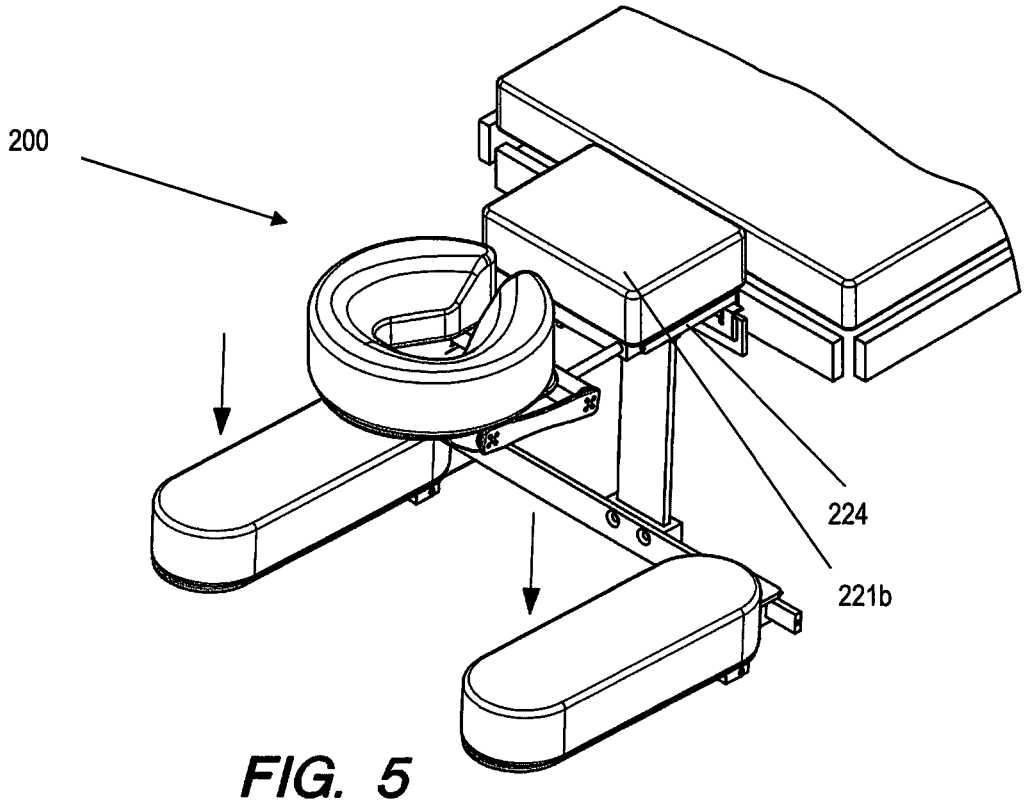
FIG. 5 is a perspective view of a preferred embodiment of the AEPD, arm board assemblies installed, demonstrating vertical adjustability of arm board assemblies.
Figure 6:
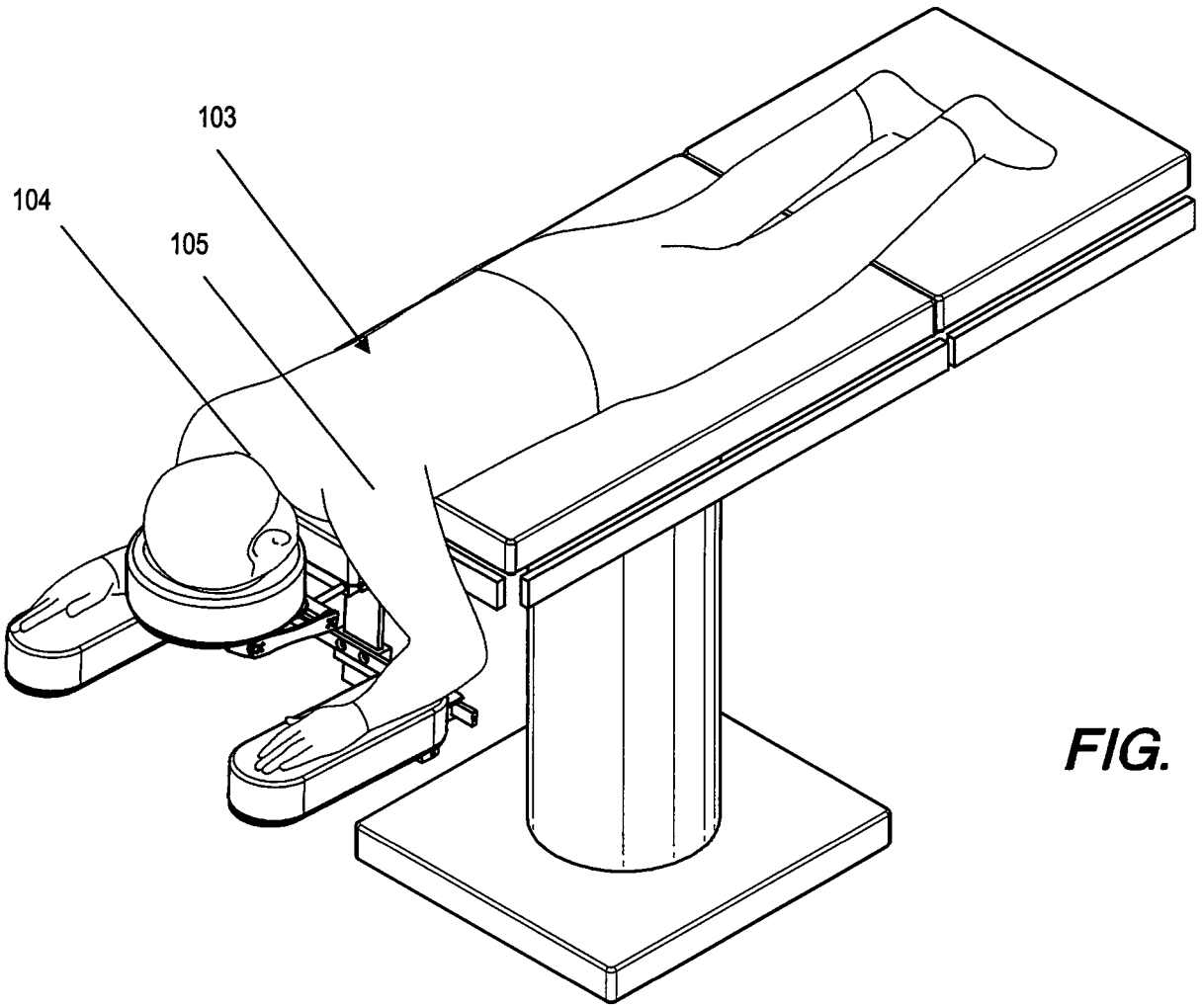
FIG. 6 is a perspective view of a preferred embodiment of the AEPD demonstrating prone positioning of patient with head/neck and shoulders in neutral, relaxed position.
Figure 7:
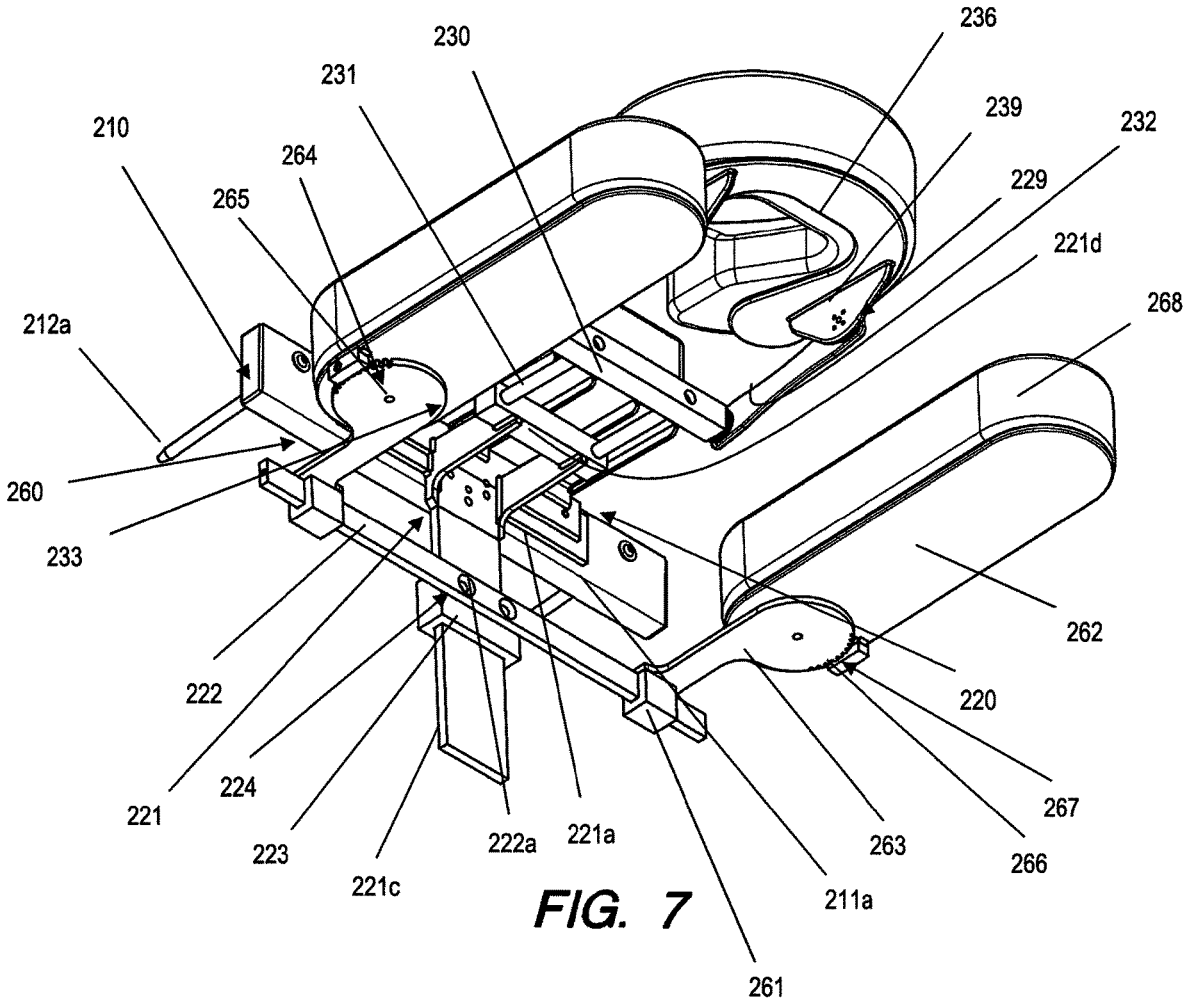
FIG. 7 is a perspective view of the underside of the AEPD, fully assembled.
Figure 8:
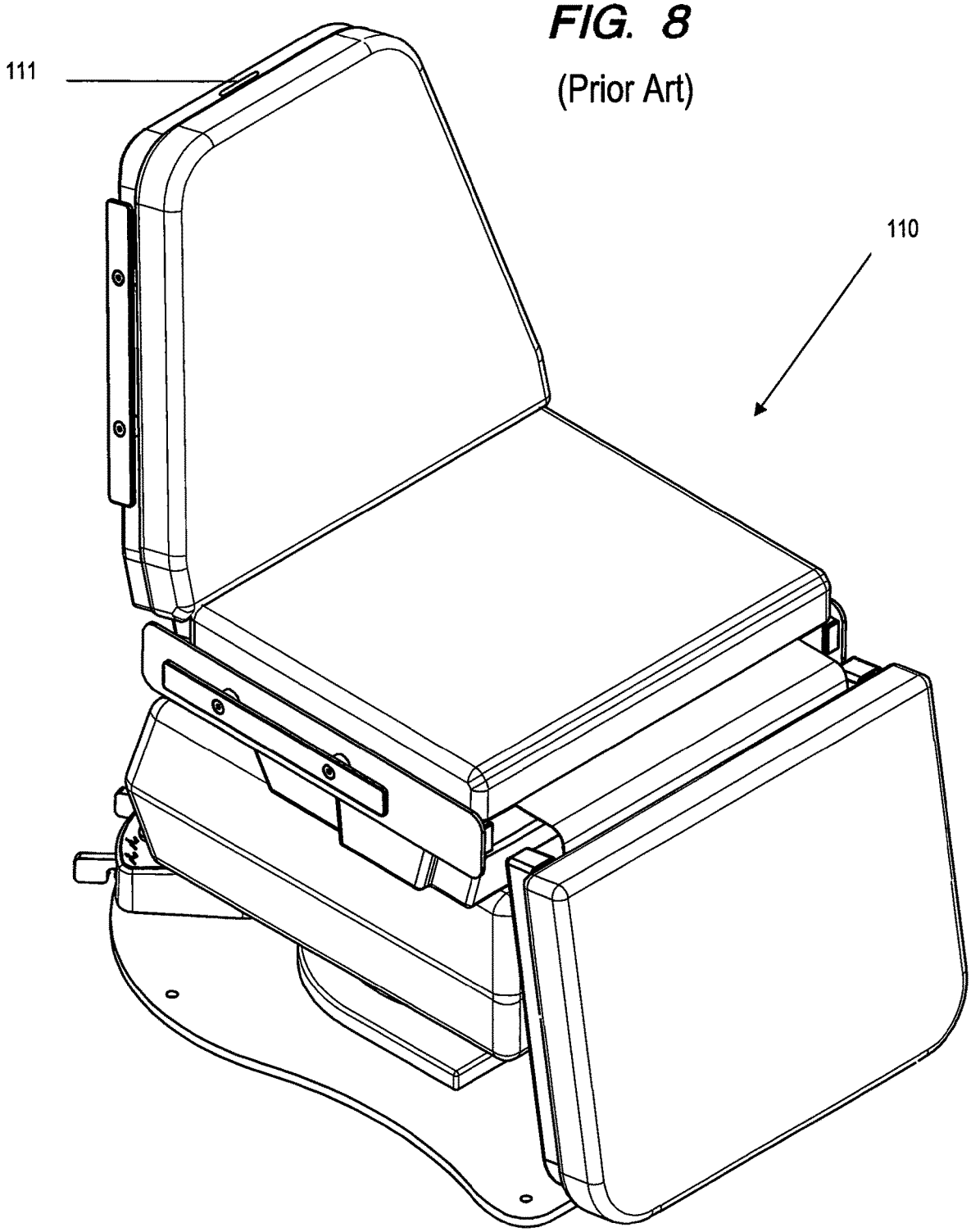
FIG. 8 (Prior Art)
FIG. 8 (Prior Art) is a perspective view of a standard surgical chair in the upright position.
Figure 9:
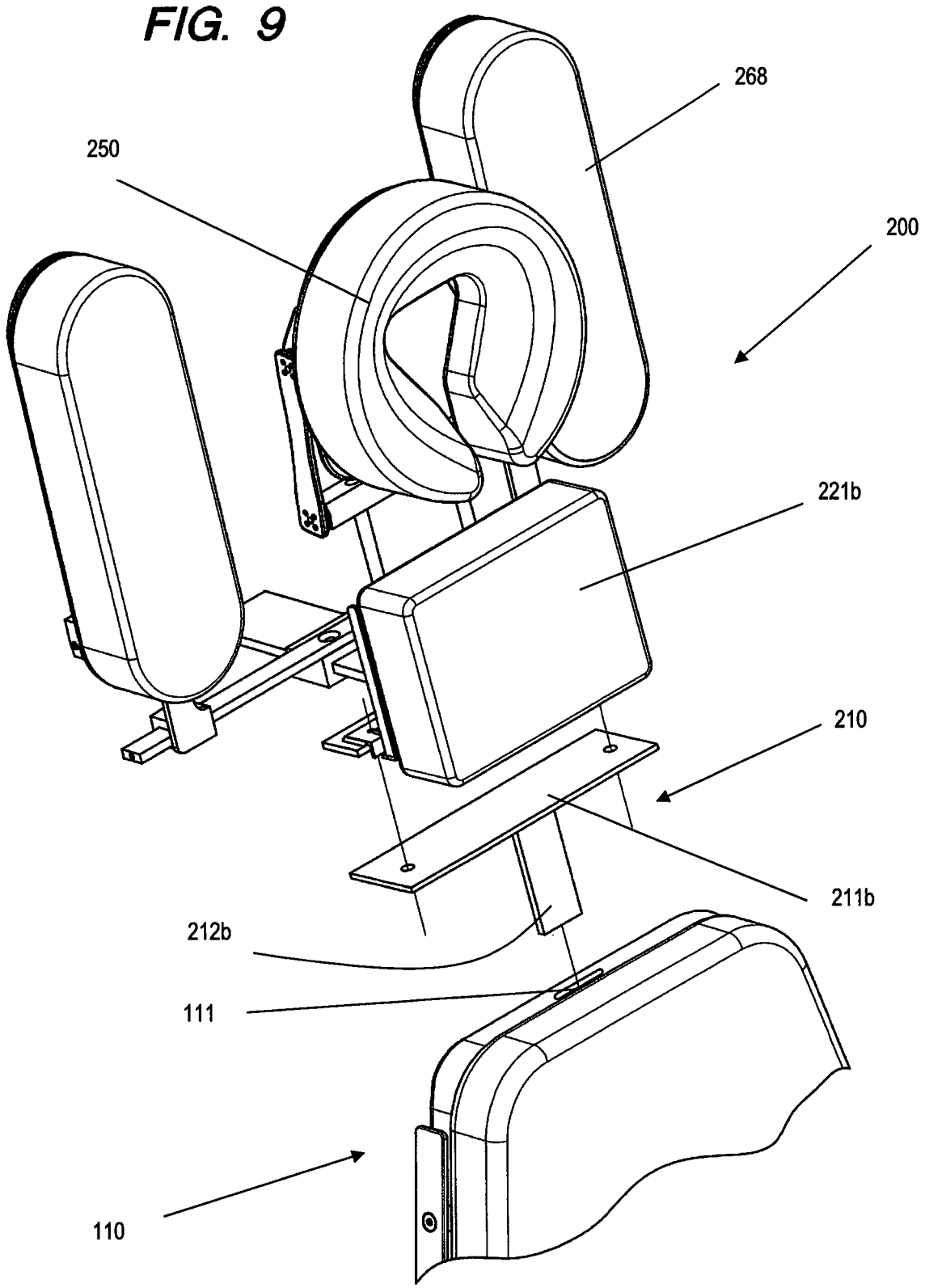
FIG. 9 is a perspective view of an embodiment of the AEPD showing how the main support assembly of the AEPD inserts into the existing mounting means of the head support of a standard surgical chair.
Figure 10:
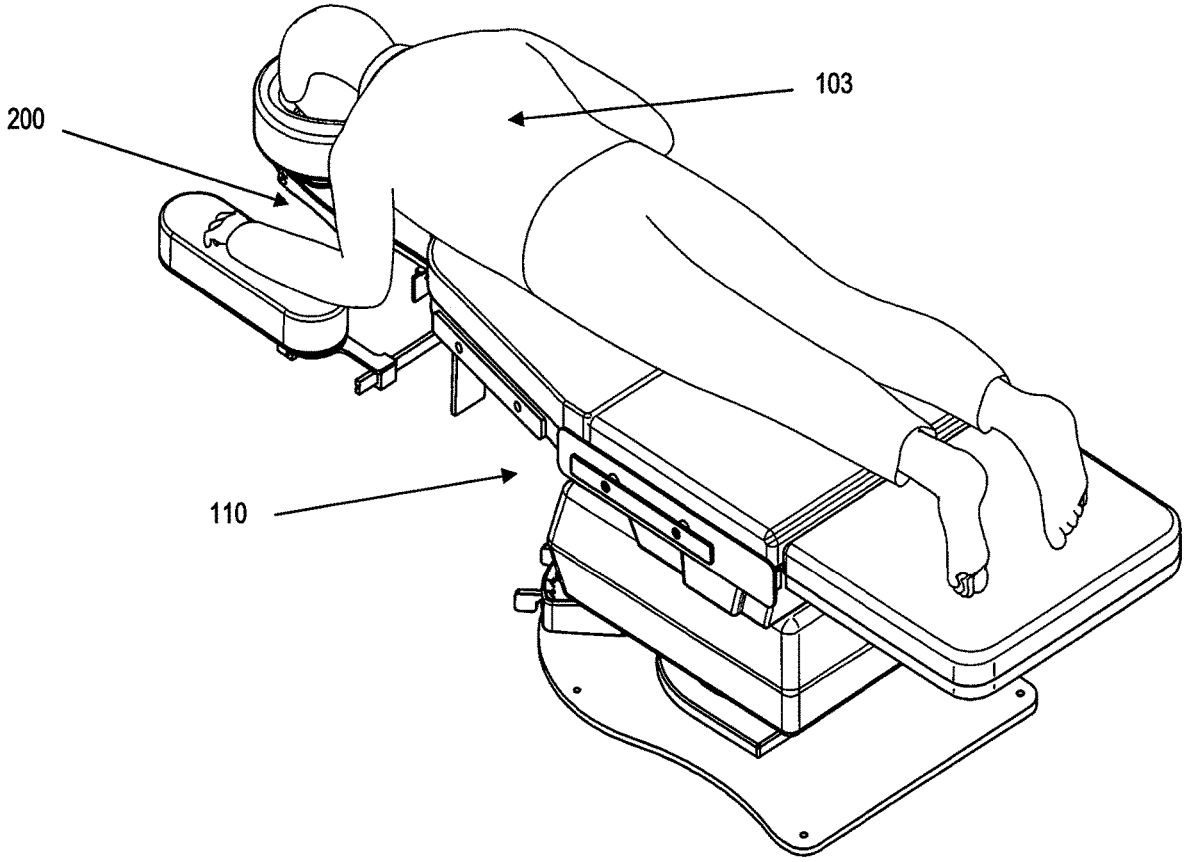
FIG. 10 is a perspective view of the AEPD installed on standard surgical chair in flat position demonstrating prone positioning of patient with head/neck and shoulders in neutral, relaxed position.

One of the main features of the AEPD 200 disclosed herein is the complete adjustability of the individual support components to accommodate patients 103 of different morphology and joint restrictions. The main support assembly 220, which supports the patient's chest, can be adjusted for height vertically by utilizing different chest cushion 221*b* thicknesses, widths, and lengths for male/female patients of different chest sizes. Standard gel pads, pillows and other positioning aids, available in most OR stores, may be employed to enhance patient safety and comfort. The arm support assemblies 260 can be adjusted up and down vertically to accommodate humeral length, and scapular protraction/retraction. This embodiment utilizes a manual process for that vertical adjustment but a geared or mechanical system could be utilized to accomplish this function. The arm support assemblies 260 can be adjusted for width horizontally by manually sliding along the arm board rail 222 to accommodate patients of varying chest width. The arm support assemblies 260 can also be rotated in the horizontal plane to accommodate differing degrees of patient shoulder 105 internal/external rotation as shown in FIG. 4. The head support assembly 229 can be adjusted longitudinally to accommodate patients with different chin to chest spacing. The head support assembly 229 can also be adjusted up and down vertically to accommodate lower cervical spine flexion/extension and tilted in the sagittal plane to accommodate upper cervical flexion/extension as shown in FIG. 4. As such, the patient's prone positioning could be established prior to anesthesia administration to allow the patient 103 to verbalize satisfactory comfort. Furthermore, the patient's position during surgery can be easily adjusted by the simple manipulation of the AEPD's various adjustment features.

As an alternative to the plastic CO2/O2 mask typically used with the AEPD 200, another embodiment of the AEPD 200 includes a plastic CO2/O2 cup that is removably connected to the underside of the head support assembly 229. The CO2/O2 cup accepts tubing connectors for CO2 monitoring and O2 delivery that would normally be used with any nose/mouth mask. The CO2/O2 cup is molded out of plastic; however, various materials and methods could be used to fabricate the CO2/O2 cup and are included within the scope of this disclosure.

The AEPD 200 is generally employed by the following steps for surgical tables and similarly for surgical chairs.

A. General set up.

1. Employment of the device is typically done or supervised by the anesthesia provider (the AP) with operating room (OR) personnel assistance.

2. Remove the head end table segment 101 of the standard surgical table 100 and simply insert the AEPD 200 table insert rods 212*a* into the existing head end attachment means 107 on the standard surgical table 100. Tighten existing head end attachment knobs to fasten the AEPD 200 to standard surgical table 100. The head support assembly 229 is typically left attached to the main support assembly 220 for storage when not in use.
3. Attach arm board assemblies 260.
4. Wipe down all of the components of the AEPD 200 with CyDex or another disinfectant.
5. When dry, make preliminary adjustments and "drape" the AEPD 200.

B. For patients that will be conscious or sedated during the procedure:
1. After the patient 103 arrives and informed consent is obtained, the AP starts IV as required, answers patient questions and explains how the patient will be positioned and how the AEPD 200 will be adjusted for their personalized comfort.
2. OR personnel assist the patient 103 onto the table and into the prone position. The patient is able to verbalize adjustments needed for comfort.
3. The AP makes final adjustments to the AEPD 200 to achieve maximum personal comfort for the patient with their assistance and input.

C. For patients that will be unconscious during the procedure:
1. After the patient 103 arrives and informed consent is obtained, the AP starts IV as required, answers patient questions and explains how the patient will be positioned and how the AEPD 200 will be adjusted for their personalized comfort. Patient 103 may provide input on positioning prior to administration of anesthesia.
2. The AP renders the patient unconscious via induction and intubation, while in the supine position on a stretcher or gurney.
3. OR personnel carefully roll the patient 103 onto the surgical table with AEPD 200 installed, and into the prone position.
4. The AP makes final adjustments to the AEPD 200 utilizing patient input and employing provider skill and experience to eliminate positioning risks for the patient.

D. The head support assembly 229 allows for the monitoring of patient breathing. A simple CO2 return, O2 mask or nasal cannula, with tubing, can be fitted over the patient's nose and mouth, as needed for the procedure, and accommodated with the opening in the face cushion 250. Easy access provided by the head support design also allows for general anesthesia using an endotracheal tube (ETT). A laryngeal mask airway (LMA) may also be employed if desired by the AP. In another embodiment, a plastic CO2/O2 cup can be removably connected to the underside of the head support assembly 229. The CO2/O2 cup accepts tubing connectors for CO2 monitoring and O2 delivery that would normally be used with any nose/mouth mask.

E. The AEPD 200 can also be used in cases where the patient 103 must be positioned in supine. By positioning the patient supine on the head support assembly 229 and main support frame chest support plate 221*a* and chest cushion 221*b*, without attaching the arm board assemblies 260, the device eliminates the obstruction on either side of the head and neck caused by the width of the normal head end table segment 101 of a standard surgical table 100. The patient's arms can then be secured in a tucked position alongside the body, and the shoulders can be relaxed and dropped. The patient's head position is then adjusted by adjusting the head support assembly 229, which provides an improved anterior approach for oral or neck surgical procedures.

F. The surgeon (or surgeons) proceeds with the surgical procedure(s)

G. To get patients off the table/device after the procedure(s):
1. For conscious patients, the AP terminates any sedation and assists the patient in moving off the table, "under their own power."
2. For unconscious patients, OR personnel carefully roll the patient off the table onto a stretcher or gurney and into the supine position.
3. The AP awakens and extubates the patient.

H. The OR staff wipes down all AEPD components with CyDex or another disinfectant and, when dry, the device and its components are put into storage.

The foregoing description and drawings comprise illustrative embodiments of the present invention. Having thus described exemplary embodiments of the present invention, it should be noted by those skilled in the art that the disclosures within are exemplary only, and that various other alternatives, adaptations, and dimensional or strengthening modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein.

We claim:

1. An adaptive ergonomic positioning device comprising: a. an insert assembly wherein said insert assembly is comprised of a removable connection means on a first side of said insert assembly to a surgical table existing head end table segment attachment means or a surgical chair existing head end chair segment attachment means; b. a main support assembly connected to a second side of said insert assembly, wherein said main support assembly is further comprised of a main support frame; c. a head support assembly connected to said main support frame; and d. at least one arm support assembly, configured to support a patient's arm, connected to said main support frame; wherein said adaptive ergonomic positioning device is removably connected to said surgical table existing head end table segment attachment means or said surgical chair existing head end chair segment attachment means.

2. The adaptive ergonomic positioning device of claim 1 where said insert assembly removable connection means is comprised of two table insert rods.

3. The adaptive ergonomic positioning device of claim 1 where said insert assembly connection means is comprised of a chair insert frame and a chair insert plate.

4. The adaptive ergonomic positioning device of claim 1 where said second side of said insert assembly is opposite of said first side.

5. The adaptive ergonomic positioning device of claim 1 where said main support assembly is further comprised of a chest support plate.

6. The adaptive ergonomic positioning device of claim 1 where said a main support frame provides a removable means to connect said head support assembly and said at least one arm support assembly to said main support frame.

7. The adaptive ergonomic positioning device of claim 6 where said main support frame comprises the means to connect an arm board rail bracket.

8. The adaptive ergonomic positioning device of claim 7 where said arm board rail bracket provides the connection means for an arm board rail.

9. The adaptive ergonomic positioning device of claim 8 where said arm board rail provides the connection means for said at least one arm support assembly.

10. The adaptive ergonomic positioning device of claim 9 where said at least one arm support assembly is further comprised of at least one arm board.

11. The adaptive ergonomic positioning device of claim 6 where said head support assembly is comprised of head support slide rods, which insert through corresponding holes in a slide rod receiver of said main support frame.

12. The adaptive ergonomic positioning device of claim 11 where said head support slide rods are connected to a head support slide bar.

13. The adaptive ergonomic positioning device of claim 12 where two head support arms are connected to said head support slide bar.

14. The adaptive ergonomic positioning device of claim 13 where a face plate is connected to said two head support arms and said head support slide bar.

15. The adaptive ergonomic positioning device of claim 1 where said main support assembly is comprised of means to adjust the vertical height of said main support assembly.

16. The adaptive ergonomic positioning device of claim 1 where said head support assembly is comprised of means for longitudinal, vertical, and rotational adjustment of said head support assembly.

17. The adaptive ergonomic positioning device of claim 1 where said at least one arm support assembly is comprised of means for vertical, horizontal, and rotational adjustment of said at least one arm support assembly.

* * * * *